US008811652B2

(12) United States Patent
Fujitani

(10) Patent No.: US 8,811,652 B2
(45) Date of Patent: Aug. 19, 2014

(54) ELECTRODYNAMIC SPEAKER AND METHOD FOR MANUFACTURING THE SAME

(71) Applicant: Onkyo Corporation, Osaka (JP)

(72) Inventor: Takeshi Fujitani, Osaka (JP)

(73) Assignee: Onkyo Corporation, Osaka (JP)

( * ) Notice: Subject to any disclaimer, the term of this patent is extended or adjusted under 35 U.S.C. 154(b) by 0 days.

(21) Appl. No.: 13/676,629

(22) Filed: Nov. 14, 2012

(65) Prior Publication Data

US 2013/0182885 A1 Jul. 18, 2013

(30) Foreign Application Priority Data

Jan. 16, 2012 (JP) ..... 2012-5806

(51) Int. Cl.

| | |
|---|---|
| ***H04R 1/00*** | (2006.01) |
| ***H04R 1/06*** | (2006.01) |
| ***H04R 3/00*** | (2006.01) |
| ***H04R 31/00*** | (2006.01) |
| *H04R 1/10* | (2006.01) |

(52) U.S. Cl.

CPC .. *H04R 3/00* (2013.01); *H04R 1/06* (2013.01); *H04R 31/00* (2013.01); *H04R 2499/15* (2013.01); *H04R 1/1008* (2013.01)

USPC ..... 381/409; 381/400; 381/433

(58) Field of Classification Search

USPC ..... 381/409, 433, 400

See application file for complete search history.

(56) References Cited

U.S. PATENT DOCUMENTS

| | | | | |
|---|---|---|---|---|
| 4,158,756 | A * | 6/1979 | Keezer | 381/433 |
| 4,737,992 | A * | 4/1988 | Latham-Brown et al. | 381/404 |
| 5,040,221 | A * | 8/1991 | Edwards et al. | 381/409 |
| 7,181,040 | B2 * | 2/2007 | Ohta | 381/398 |
| 7,715,585 | B2 * | 5/2010 | Nagata et al. | 381/412 |

FOREIGN PATENT DOCUMENTS

| | | |
|---|---|---|
| JP | 2004-032008 | 1/2004 |
| JP | 3653815 | 6/2005 |

* cited by examiner

*Primary Examiner* — Curtis Kuntz
*Assistant Examiner* — Ryan Robinson
(74) *Attorney, Agent, or Firm* — Renner, Otto, Boisselle & Sklar, LLP.

(57) ABSTRACT

An electrodynamic speaker in which the number of steps of forming a tinsel wire to be connected to a voice coil and connecting the tinsel wire to a terminal can be reduced is provided.

A frame of the electrodynamic speaker includes an edge mounting section, a magnetic circuit mounting section, a coupling section for coupling the edge mounting section and the magnetic circuit mounting section so as to define a plurality of window sections, a terminal fixing section for fixing a terminal, and at least one void for dividing the edge mounting section having an approximately annular shape, the void being communicatively connected to the window sections of the coupling section. A middle portion of the tinsel wire passes through the void or the window sections communicatively connected to the void, and the other end of the tinsel wire is connected and fixed to the terminal.

8 Claims, 5 Drawing Sheets

ELECTRODYNAMIC SPEAKER AND METHOD FOR MANUFACTURING THE SAME

BACKGROUND OF THE INVENTION

1. Field of the Invention

The present invention relates to a small electrodynamic speaker having excellent audio reproducing performance and including a frame and a magnetic circuit, the electrodynamic speaker in which the number of steps of forming the tinsel wire to be connected to a voice coil and connecting the tinsel wire to a terminal can be reduced, and relates to a method for manufacturing the electrodynamic speaker.

2. Description of the Related Art

In audio equipment such as displays to which speakers for reproducing audio are mounted, it is demanded that spaces required for mounting of speakers are made small. In particularly small or elongated (rectangular, oval (including an oblong shape and a track shape) electrodynamic speakers, since a space on a speaker diaphragm rear surface where a tinsel wire (or lead wire) for supplying an audio signal current to a voice coil is arranged is narrow, there is a problem that the tinsel wire contacts with the diaphragm or the frame and thus a noise is easily generated. Small electrodynamic speakers have a disadvantage because of various reasons such that when an edge or a damper for supporting a vibration system including a speaker diaphragm is to be provided, the tinsel wire contact with them more easily and thus the speakers cannot be downsized. Therefore, in order to solve the problem, various speakers are conventionally proposed.

For example, an in-vehicle speaker includes a diaphragm where a frame is coupled with an upper surface of a magnetic circuit having a magnetic gap and a voice coil fitted into the magnetic gap is coupled with a peripheral edge of the frame. This speaker is configured so that the lead wire and leading line lead from the voice coil are connected to a front surface of the diaphragm, and the connected leading line is connected to a connector coupled with a gasket coupled with the periphery edge of the frame. The speaker is made of copper foil where the leading line is inserted into the mold-injected diaphragm (Patent Gazette No. 3653815).

A speaker has a speaker diaphragm, a speaker edge, a frame, a voice coil, a signal input terminal, and a tinsel wire for connecting the voice coil and the signal input terminal. The speaker edge has an edge movable section for connecting an outer periphery of the speaker diaphragm and/or a voice coil bobbin, and an edge outer periphery fixed continuously from the edge movable section to the frame. The edge outer periphery includes an edge outer periphery first fixing section that extends in a direction approximately vertical to a vibrating direction of the speaker diaphragm, and an edge outer periphery second fixing section that extends in a direction approximately vertical to the edge outer periphery first fixing section. The frame has a frame first fixing section to be coupled to the edge first fixing section, and a frame second fixing section to be coupled to the edge second fixing section. Preferably, the end of the tinsel wire on a side of the signal input terminal is maintained by the edge outer periphery second fixing section of the speaker edge (Japanese Patent Application Laid-Open No. 2004-32008). As described in paragraph 0014 of Patent Gazette No. 3653815, according to the present invention, the lowest end of the edge outer periphery second fixing section maintains the end of the tinsel wire on the side of the signal input terminal, so that the tinsel wire is prevented from contacting with the speaker edge, and as a result, generation of noises can be prevented.

However, in electrodynamic speakers, in order to solve the above problem, since the appearance of the speakers is maintained or total heights of the speakers keep low, the tinsel wire cannot be occasionally arranged on the front face side of the speaker diaphragms unlike Patent Gazette No. 3653815. Further, the edge outer periphery of the speaker edge is bonded and fixed at a time of manufacturing the speaker, so that the edge outer periphery second fixing section shapes a wiring form of the tinsel wire positioned below the speaker edge as Japanese Patent Application Laid-Open No. 2004-32008. As a result, steps of shaping the wiring form of the tinsel wire in the speaker manufacturing process can be reduced, and thus manufacturing efficiency can be improved. However, since the wiring form of the tinsel wire cannot be shaped in advance, there is a problem that variability might occur at a time of mass production. In small electrodynamic speakers, in the case where the tinsel wire is arranged on the rear face of the speaker diaphragm, when the tinsel wire cannot be shaped in advance before the speaker diaphragm is placed on the frame, there is a problem that the tinsel wire contacts with another portion due to the variability at the time of mass production, and thus a noise is generated.

SUMMARY OF THE INVENTION

The present invention is devised in order to solve the problem of the above conventional technique, and its object is to provide a small electrodynamic speaker having excellent audio reproducing performance and including a frame and a magnetic circuit, the electrodynamic speaker in which the number of steps of forming a tinsel wire to be connected to a voice coil and connecting the formed tinsel wire to a terminal can be reduced, and relates to a method for manufacturing the electrodynamic speaker.

An electrodynamic speaker according to the present invention, comprises: a frame having an approximately basket-shaped substrate; a diaphragm to be held in the frame; an edge to be coupled to an outer peripheral end of the diaphragm; a voice coil to be connected to the diaphragm; a magnetic circuit having a magnetic void into which the voice coil is inserted; a tinsel wire whose one end is connected and fixed to the voice coil; and a terminal to be coupled to the frame, wherein the frame includes an edge mounting section for mounting the edge formed on one side of the substrate, a magnetic circuit mounting section for mounting the magnetic circuit formed on the other side of the substrate, a coupling section for coupling the edge mounting section and the magnetic circuit mounting section so as to define a plurality of window sections, a terminal fixing section for fixing the terminal, and at least one void for dividing the edge mounting section having an approximately annular shape, the void being communicatively connected to the window sections of the coupling section, a middle portion of the tinsel wire passes through the void or the window sections communicatively connected to the void, and the other end of the tinsel wire is connected and fixed to the terminal.

Preferably, the edge includes an inner periphery fixing section to be coupled to the outer peripheral end of the diaphragm, an outer periphery fixing section to be fixed to the edge mounting section of the frame, and a support movable section for coupling the inner periphery fixing section and the outer periphery fixing section in a vibration-enabled manner, the outer periphery fixing section includes a tinsel wire fixing section that has a protrusion on a position corresponding to the void of the edge mounting section and fixes the middle portion of the tinsel wire using the protrusion that is entirely or partially held in the void.

Preferably, the diaphragm and the edge are formed integrally with each other, and at least the diaphragm and the support movable section of the edge are made of different materials.

Preferably, the diaphragm and the outer periphery fixing section of the edge are made of the same material.

Further, a method for manufacturing an electrodynamic speaker according to the present invention, the electrodynamic speaker includes a frame having an approximately basket-shaped substrate, a diaphragm to be held in the frame, an edge to be coupled to an outer peripheral end of the diaphragm, a voice coil to be coupled to the diaphragm, a magnetic circuit having a magnetic void into which the voice coil is inserted, a tinsel wire whose one end is connected and fixed to the voice coil, and a terminal to be coupled to the frame. The method comprises the steps of: forming the frame including an edge mounting section for mounting the edge formed on one side of the substrate, a magnetic circuit mounting section for mounting the magnetic circuit formed on the other side of the substrate, a coupling section for coupling the edge mounting section and the magnetic circuit mounting section so as to define a plurality of window sections, a terminal fixing section for fixing the terminal, and at least one void for dividing the edge mounting section having an approximately annular shape, the void being communicatively connected to the window sections of the connecting section; coupling the terminal to the terminal fixing section of the frame; coupling the diaphragm, the edge, the voice coil and the tinsel wire so as to constitute a vibration system; when the vibration system is moved from one side to the other side of the substrate of the frame, allowing a middle portion of the tinsel wire to pass through the void of the frame or the window sections communicatively connected to the void and placing and fixing the edge to the edge mounting section of the frame; connecting and fixing the other end of the tinsel wire to the terminal; and mounting the magnetic circuit to the magnetic circuit mounting section of the frame so as to arrange the voice coil on the magnetic void of the magnetic circuit.

Preferably, the method for manufacturing the electrodynamic speaker according to the present invention, further comprises the steps of: forming the edge so that the edge includes an inner periphery fixing section to be coupled to the outer peripheral end of the diaphragm, an outer periphery fixing section to be fixed to the edge mounting section of the frame, and a support movable section for coupling the inner periphery fixing section and the outer periphery fixing section in a vibration-enabled manner, and the outer periphery fixing section includes a tinsel wire fixing section for fixing the middle portion of the tinsel wire to a protrusion on a position corresponding to the void of the edge mounting section; placing and fixing the edge on the edge mounting section of the frame so that the protrusion including the tinsel wire fixing section is entirely or partially held in the void; and fixing the middle portion of the tinsel wire using the tinsel wire fixing section.

Preferably, the method for manufacturing the electrodynamic speaker according to the present invention, further comprises a step of forming the diaphragm and the edge integrally so that at least the diaphragm and the support movable section of the edge are made of different materials.

Preferably, the method for manufacturing the electrodynamic speaker according to the present invention, further comprises a step of forming the diaphragm and the outer periphery fixing section of the edge using the same material.

A function of the present invention is described below.

The electrodynamic speaker of the present invention includes a frame having an approximately basket-shaped substrate, a diaphragm held in the frame, an edge to be coupled to an outer periphery end of the diaphragm, a voice coil to be connected to the diaphragm, a magnetic circuit having a magnetic void into which the voice coil is inserted, a tinsel wire whose one end is connected and fixed to the voice coil, and a terminal to be connected to the frame. The frame for the speaker is formed by resin or metal, and the speaker is configured to include, on an inside of the approximately basket-shaped substrate, a speaker diaphragm, a voice coil for transmitting a drive force to the speaker diaphragm, and a damper and/or an edge for supporting the speaker diaphragm in a vibration-enabled manner.

The frame of the electrodynamic speaker has an edge mounting section for mounting an edge formed on one side of the substrate, a magnetic circuit mounting section for mounting the magnetic circuit formed on the other side of the substrate, a coupling section for coupling the edge mounting section and the magnetic circuit mounting section so as to define a plurality of window sections, and a terminal fixing section for fixing a terminal. The approximately basket-shaped substrate is a shape including at least a front side of the frame constituting the edge mounting section or the mounting section, a rear side of the frame constituting the magnetic circuit fixing section or a damper mounting section, and the coupling section for coupling them so as to define the window sections.

Further, this frame includes at lease one void that divides the approximately annular edge mounting section and communicatively connects with a window section of the connecting section. That is to say, the edge mounting section of the frame entirely has an approximately annular shape including a planar portion for fixing the edge and is divided by at least one void. This void is defined by a slit that is formed from, for example, one direction to the other direction of the substrate or formed from an inner periphery to an outer periphery of the substrate, and communicatively connects with the window section of the coupling section. As a result, in the electrodynamic speaker of the present invention, the tinsel wire whose one end is connected and communicatively connects with the voice coil constituting the vibration system of the electrodynamic speaker is arranged so that its middle portion passes through the void or the window section communicatively connecting to the void, and the other end of the tinsel wire is connected and fixed to the terminal.

In a method for manufacturing the electrodynamic speaker according to the present invention, since the frame includes the void for dividing the approximately annular edge mounting section as described, when the vibration system including the tinsel wire preliminarily processed in advance is moved from one side to the other side of the substrate of the frame so as to be placed on a predetermined position, the middle portion of the tinsel wire is allowed to easily pass through the void of the frame or the window section communicatively connecting to the void. As a result, the number of steps of manufacturing the electrodynamic speaker can be reduced. That is to say, since the step of putting a front end of the tinsel wire into the window section below the edge mounting section that requires a considerable time is replaced by an easy step of simply allowing the middle portion of the tinsel wire through the void of the edge mounting section, the number of steps of forming the tinsel wire to be connected to the voice coil so as to connect it to the terminal can be reduced.

Further, the edge of the electrodynamic speaker may include an inner periphery fixing section to be coupled to an outer peripheral end of the diaphragm, an outer periphery fixing section to be fixed to the edge mounting section of the frame, and a support movable section for coupling the inner periphery fixing section and the outer periphery fixing section in a vibration-enabled manner. The outer periphery fixing section may have a protrusion on a position corresponding to the void of the edge mounting section, and the protrusion to be entirely or partially held in the void may include a tinsel wire fixing section for fixing the middle portion of the tinsel wire. When the outer periphery fixing section corresponding to a gasket for mounting the edge to the frame is formed as a protrusion including the tinsel wire fixing section for fixing the middle portion of the tinsel wire, the entire or partial protrusion is held in the void of the edge mounting section. As a result, the number of steps of forming the tinsel wire to be connected to the voice coil can be further reduced. When the edge is placed and fixed to the edge mounting section of the frame, the middle portion of the tinsel wire is allowed to easily pass through the void of the frame or a window section communicatively connecting to the void.

It is to be noted that the diaphragm and the edge may be formed integrally with each other by different resins according to a method such as two-color formation, and at least the diaphragm and the support movable section of the edge may be made of different materials. Further, the diaphragm and the outer periphery fixing section of the edge may be made of the same material. The formation of the protrusion including the tinsel wire fixing section for fixing the middle portion of the tinsel wire becomes easy, and the tinsel wire can be shaped in advance before the speaker diaphragm is placed on the frame in the step of manufacturing the small electrodynamic speaker. A problem such that when the tinsel wire is arranged on the rear surface of the speaker diaphragm, the tinsel wire contacts with another portion and a noise is generated due to variability at the time of mass production is reduced.

According to the electrodynamic speaker of the present invention, the small electrodynamic speaker that has the excellent audio reproducing performance and is suitable for mounting to a device such as a display, the electrodynamic speaker in which the number of the steps of forming tinsel wire to be connected to the voice coil and connecting the tinsel wire to a terminal can be reduced, can be provided.

DETAILED DESCRIPTION OF THE PREFERRED EMBODIMENT

An electrodynamic speaker and a manufacturing method for the speaker according to preferred embodiments of the present invention will be described below, but the present invention is not limited to these embodiments.

Figure 1:
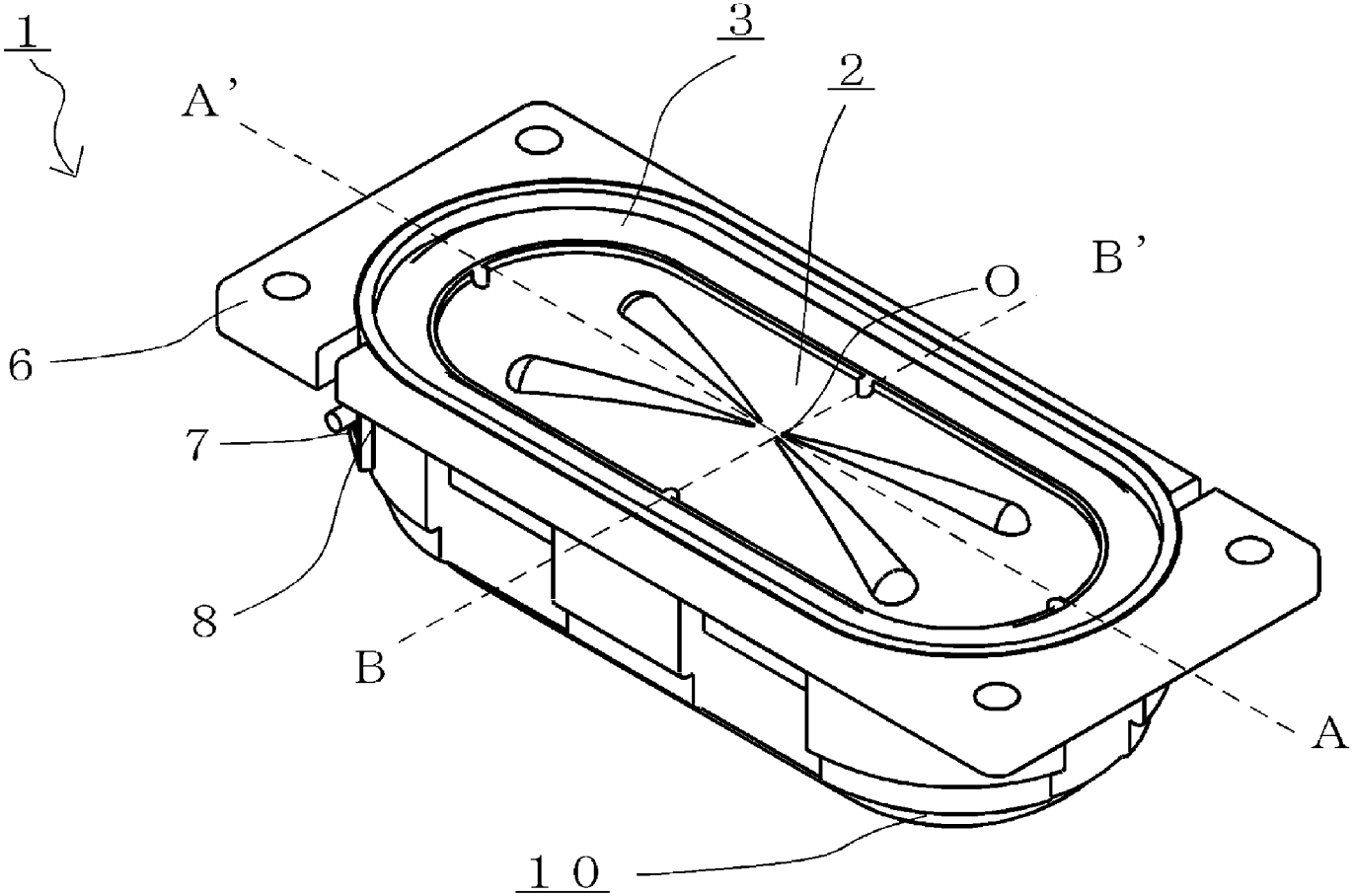
FIG. 1 is a perspective view describing an electrodynamic speaker 1 of the present invention; (first embodiment)
Figure 2:
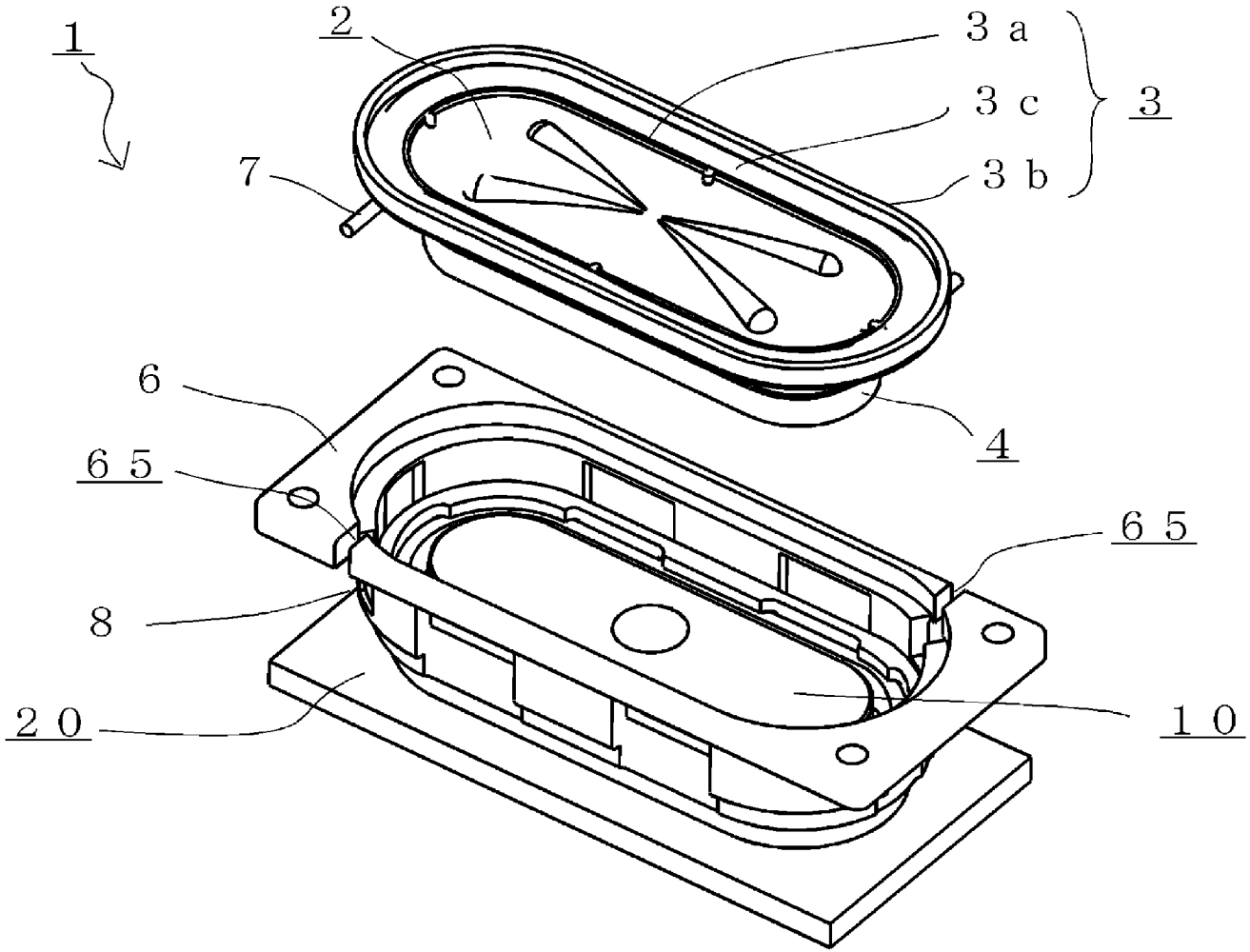
FIG. 2 is a development perspective view describing a method for manufacturing the electrodynamic speaker 1 of the present invention; (first embodiment)
Figure 3:
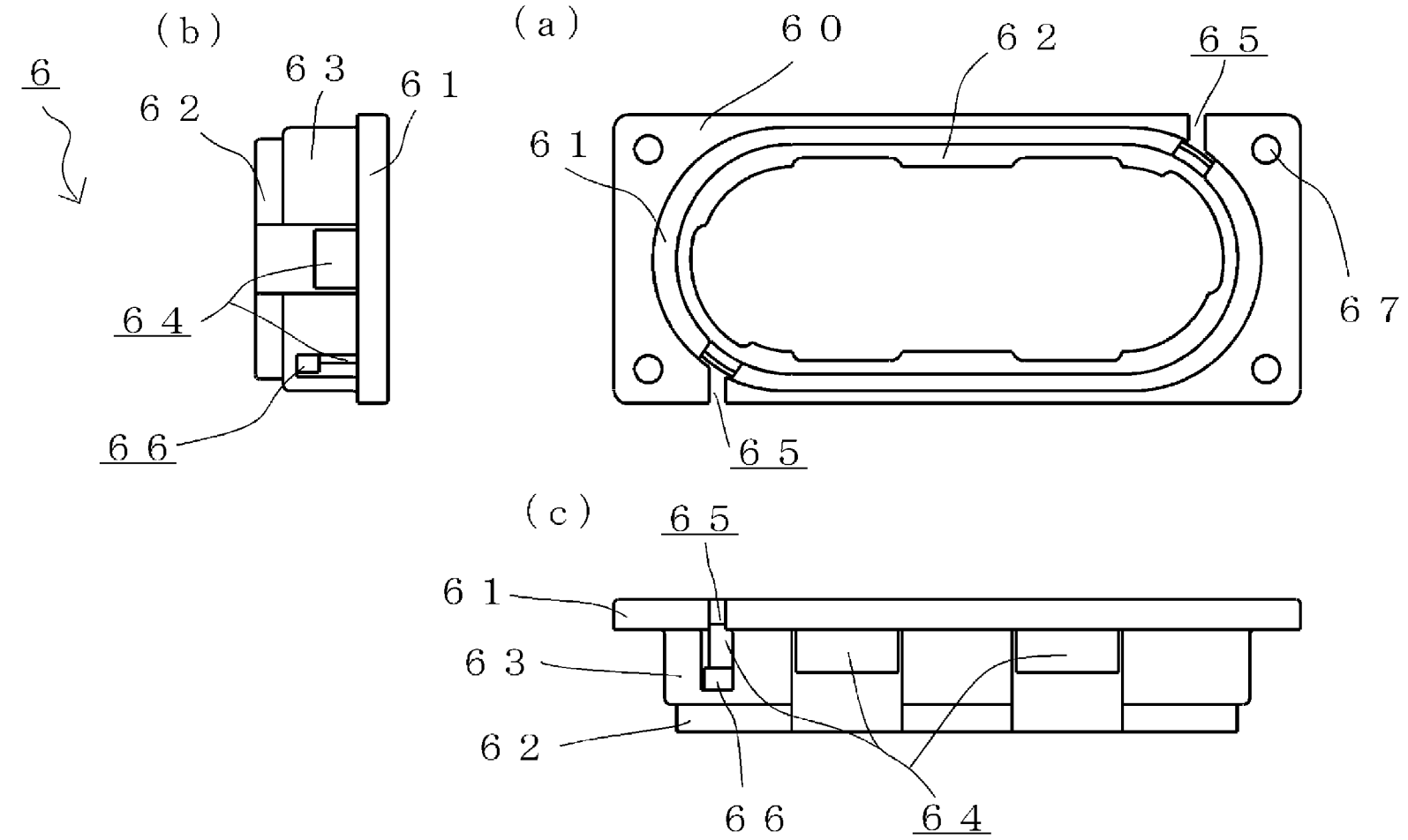
FIGS. 3A to 3C are diagrams describing a frame 6 of the electrodynamic speaker 1 of the present invention; (first embodiment)

FIG. 1 and FIG. 2 are diagrams describing preferred embodiments of the present invention. Specifically, FIG. 1 is a perspective view illustrating the electrodynamic speaker 1. Further, FIG. 2 is a development diagram describing a structure of the electrodynamic speaker 1, and a perspective view where some parts unnecessary for the description are eliminated. The electrodynamic speaker 1 includes a vibration system including a track-shaped diaphragm 2, an edge 3 and a voice coil 4, a frame 6, and a magnetic circuit 10. The electrodynamic speaker 1 is manufactured by using an assembly jig 20. FIGS. 3A to 3C are diagrams describing the frame 6 of the electrodynamic speaker 1. FIG. 3A is a plan view, FIG. 3B and FIG. 3C are side views.

The electrodynamic speaker 1 according to the embodiment is the elongated electrodynamic speaker having the track-shaped diaphragm 2. An outer peripheral end of the diaphragm 2 is supported by the edge 3, and an outer peripheral end of the edge 3 is fixed to the frame 6. The frame 6 has an elongated shape corresponding to the track-shaped diaphragm 2, and the magnetic circuit 10 fixed so as to be housed in the frame 6 also has an elongated shape where a width in a short radial direction is narrow. Therefore, the electrodynamic speaker 1 is an electrodynamic speaker that is suitable for devices with a small width for attachment of a speaker, such as a side surface of a display section of a device such as a display. A terminal 8 to which an audio signal current is supplied is attached to a side surface of the frame 6, and the magnetic circuit 10 is partially exposed on a rear surface.

The diaphragm 2 according to the embodiment has a track shape with an external dimension of about 12 mm×36 mm, and is formed by a polyolefin thermoplastic resin into a thickness of about 0.2 mm. An outer peripheral end of the diaphragm 2 is freely supported by the edge 3 in a vibration-enabled manner. The diaphragm 2 has a plurality of ribs on a convex portion at the center, and the voice coil 4 is coupled from the rear surface to a boundary portion of the outer peripheral end whose cross section has a shallow cone shape.

The edge 3 includes an inner periphery fixing section 3*a* coupled to the outer peripheral end of the diaphragm 2, an outer periphery fixing section 3*b* fixed to an edge mounting section 61 of the frame 6, described later, and a support movable section 3*c* for connecting the inner periphery fixing section 3*a* and the outer periphery fixing section 3*b* in a vibration-enabled manner. The outer periphery fixing section 3*b* may be thickened so as to be used also as a gasket. The support movable section 3*c* may be a roll edge having an approximately roll-shaped cross section or a corrugation edge having corrugation. As to the edge 3, the support movable section 3*c* may be formed by a different material that is softer and has a lower hardness than a material of the inner periphery fixing section 3*a* and the outer periphery fixing section 3*b*. The support movable section 3*c* may be formed by polyolefin thermoplastic resin, another polystyrene thermoplastic resin, polyester thermoplastic resin, polyurethane thermoplastic resin and the like. The edge 3 may be formed so as to be coupled to the diaphragm 2 manufactured separately by adhesive, or may be formed integrally with the diaphragm 2 by a manufacturing method such as two-color formation like the embodiment. When the diaphragm 2 and the outer periphery fixing section 3*b* of the edge 3 are made of the same material according to the manufacturing method such as two-color formation, since the diaphragm 2 and the edge 3 are integral with each other in advance, the number of working steps can be reduced in the step of manufacturing the electrodynamic speaker 1.

The voice coil 4 is formed into a track shape so that a coil 4*a* is wound around a cylindrical bobbin 4*b*. Further, one end of the tinsel wire 7 is connected and fixed to the coil 4*a* of the voice coil 4. Therefore, the two tinsel wires 7 are connected to both ends of the coil 4*a* so as to supply an audio signal to the voice coil 4. The other ends of the tinsel wires 7 are connected and fixed to the terminal 8 fixed to the frame 6, described later.

The magnetic circuit 10 includes a yoke with a jug-shaped cross section. The magnetic circuit 10 is an inner magnetic-type magnetic circuit where a magnet and a plate are placed inside the magnetic circuit 10, and a track-shaped magnetic void is formed between the plate and a side wall of the yoke. As a result, since a magnetic field showing high flux density is formed in the magnetic void, the coil 4*a* of the voice coil 4 is arranged in the magnetic void in the electrodynamic speaker 1. The magnetic circuit 10 is coupled to a magnetic circuit mounting section 62 of the frame 6, described later. Respective members constituting the magnetic circuit 10 are fixed by adhesive. The magnetic circuit 10 is also fixed to the magnetic circuit mounting section 62 of the frame 6 by adhesive. The magnetic circuit 10 is not limited to the structure in the present embodiment as long as it is formed with the track-shaped magnetic void.

In the step of manufacturing the electrodynamic speaker 1 according to the embodiment, as shown in FIG. 2, the magnetic circuit 10 is placed on the predetermined assembly jig 2, and the frame 6 and the vibration system including the diaphragm 2, the edge 3 and the voice coil 4 are placed thereon in this order. As a result, the coil 4*a* of the voice coil 4 can be arranged in the magnetic void of the magnetic circuit 10. When the assembly jig 20 is removed after the adhesive is solidified, the speaker vibration system including the diaphragm 2, the edge 3, the coil 4 and the tinsel wire 7 is supported to the frame 6 and the magnetic circuit 10 in a vibration-enabled manner. The frame 6 may be a metal frame obtained by forming a steel plate using press molding. It is to be noted that the present embodiment describes a case where a damper for supporting the speaker vibration system in the vibration-enabled manner is not provided, but the electrodynamic speaker 1 may additionally have a damper for supporting the voice coil 4 in the vibration-enabled manner.

As shown in FIGS. 3A to 3C, the frame 6 has an approximately basket-shaped substrate 60 formed by resin. The frame 6 has the edge mounting section 61 for mounting the edge 3 formed on one side of the substrate 60, the magnetic circuit mounting section 62 for mounting the magnetic circuit 10 formed on the other side of the substrate 60, a coupling section 63 for coupling the edge mounting section 61 and the magnetic circuit mounting section 62 so as to define a plurality of window sections 64, and the terminal fixing sections 66 for fixing the two terminals 8. A threaded screw hole 67 for mounting the electrodynamic speaker 1 to another housing and the like is formed at four corners of the edge mounting section 61 of the substrate 60. Further, in the frame 6, two voids 65 that divide the approximately annular edge mounting section 61 and are communicatively connected to the window sections 64 of the coupling section 63 are formed corresponding to the window sections 64 where the terminal fixing sections 66 are provided, respectively. The voids 65 of the frame 6 divide the approximately annular edge mounting section 61 including a plane portion for fixing the edge 3 at two places as shown in FIGS. 3A to 3C, and are communicatively connected to the window sections 64 provided with the terminal fixing sections 66. The voids 65 may be slits having a width not less than a predetermined dimension through which the tinsel wire 7 passes, and the slits may have any shape. Therefore, the speaker vibration system including the diaphragm 2, the edge 3, the coil 4 and the damper 5 is supported to the frame 6 and the magnetic circuit 10 in the vibration enabled manner. The frame 6 may be a metal frame formed by press-molding a steel plate.

In the method for manufacturing the electrodynamic speaker 1 according to present embodiment, the frame 6 is formed. The frame 6 has the approximately basket-shaped substrate 60 and includes at least the one void 65 that divides the approximately annular edge mounting section 61 and is communicatively connected to the window sections 64 of the coupling section 63. The terminal 8 is coupled to the terminal fixing section 65 of the frame 6 through a preliminary process. As shown in FIG. 2, the vibration system including the diaphragm 2, the edge 3, the voice coil 4 and the tinsel wire 7 is coupled into a predetermined shape through a preliminary process. The middle portion of tinsel wire 7 of the vibration system is allowed to pass through the void 65 of the frame 6 or the window section 64 communicatively connected to the void 65, and the edge 3 is placed and fixed to the edge mounting section 61 of the frame 6, and the other end of the tinsel wire 7 is connected and fixed to the terminal 8. Further, the magnetic circuit 10 is mounted to the magnetic circuit mounting section 62 of the frame 6, and the voice coil 4 is arranged in the magnetic void (14) of the magnetic circuit 10.

Therefore, in the electrodynamic speaker 1 in present embodiment, the tinsel wire 7 whose one end is connected and coupled to the voice coil 4 constituting the vibration system of the electrodynamic speaker is arranged so that its middle portion passes through the window section 64 communicatively connected to the void 65 of the frame 6 and the other end of the tinsel wire 7 is connected and fixed to the terminal 8. That is to say, in the method for manufacturing the electrodynamic speaker 1, since the frame includes the void 65 for dividing the approximately annular edge mounting section 61, as shown in FIG. 2, when the vibration system including the tinsel wire 7 preliminarily processed is moved from one side of the substrate 60 of the frame 6 (a side of the edge mounting section 61) to the other side (a side of the magnetic circuit mounting section 62) and is placed at a predetermined position, the middle portion of the tinsel wire 7 is allowed to easily pass through the window sections 64 communicatively connected to the void 65 of the frame 6.

As a result, in the step of manufacturing the electrodynamic speaker 1, the number of working steps can be reduced. That is to say, the step of putting the front end of the tinsel wire 7 through the window sections 64 defined below the edge mounting section 61 of the frame 6 that requires a lot of time is replaced by the easy step of allowing the middle portion of the tinsel wire 7 to simply pass through the void 65 dividing the edge mounting section 61. For this reason, the number of the steps of forming the tinsel wire 7 to be connected to the voice coil 4 and connecting the formed tinsel wire to the terminal 8 can be reduced.

In the case of the small electrodynamic speaker 1 with a small diameter, an effect of reducing the number of steps becomes great because the work for putting the front end of the tinsel wire 7 through the window sections 64 of the frame 6 requires long time. Needless to say, in the electrodynamic speaker 1 of present embodiment, the problem such that the tinsel wire 7 contacts with another portion of the frame 6 and thus a noise is generated can be reduced. The electrodynamic speaker 1 stabilizes the operation of the vibration system including the diaphragm 2 and the edge 3 so as to make it possible to realize satisfactory audio reproduction.

Figure 4:
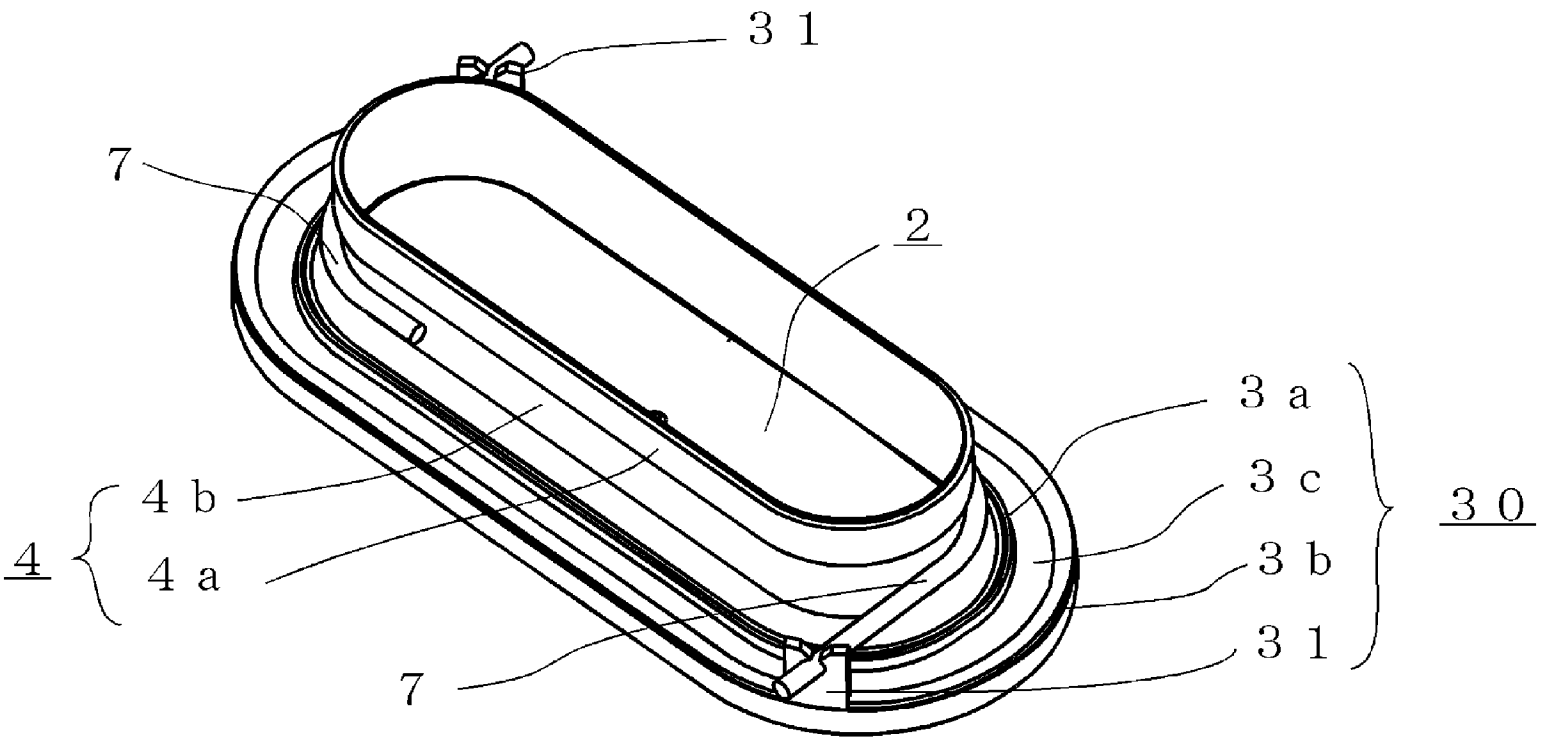
FIG. 4 is a rear perspective view describing a vibration system of another electrodynamic speaker 1*a* of the present invention (second embodiment)
Figure 5:
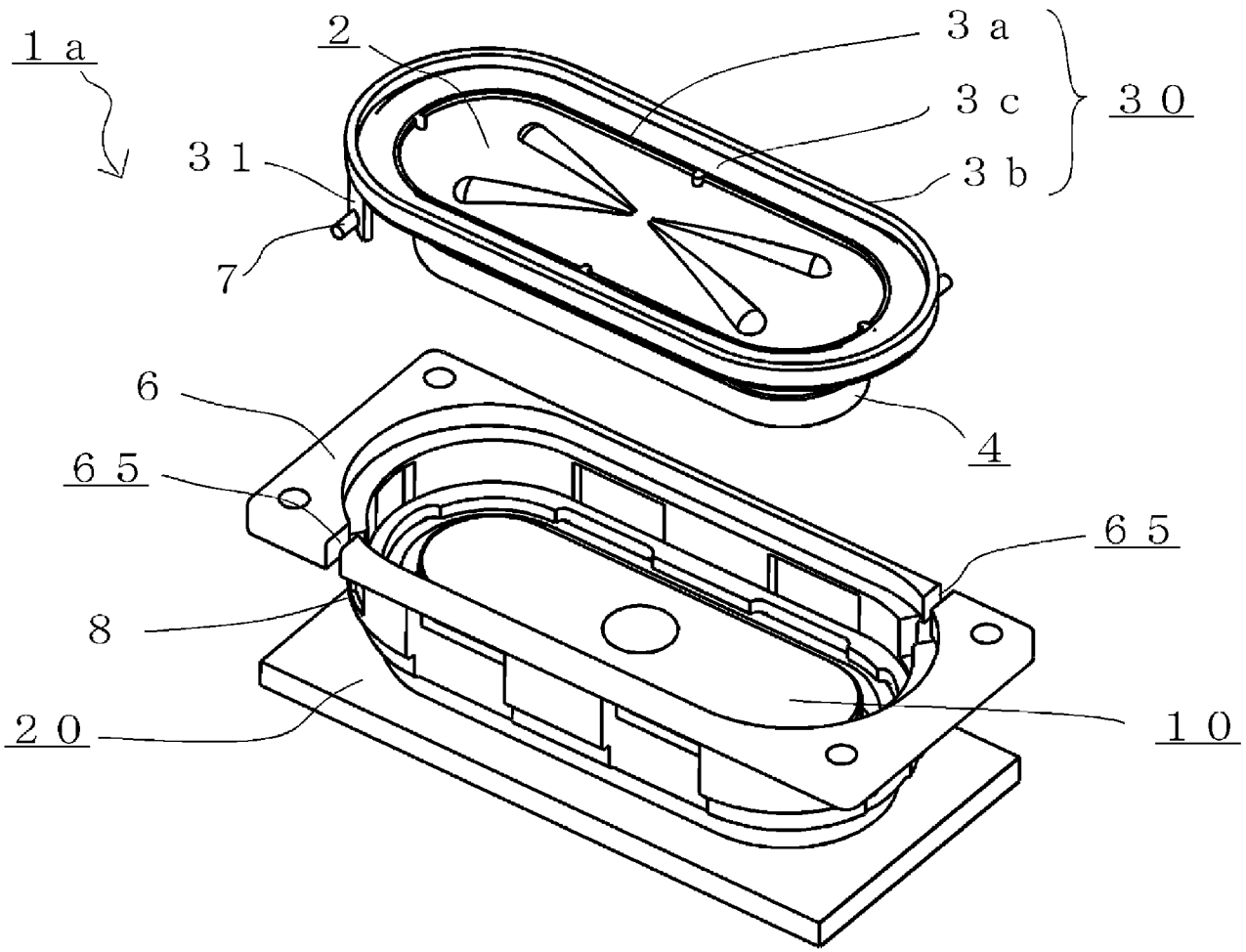
FIG. 5 is a development perspective view describing another method for manufacturing the electrodynamic speaker 1*a* according to the present invention.(second embodiment)

FIGS. 4 and 5 are diagrams describing the electrodynamic speaker 1*a* using another edge 30 according to another preferred embodiment. Specifically, FIG. 4 is a rear surface perspective view when the vibration system including the edge 30 of the electrodynamic speaker 1*a* is viewed from a rear side. FIG. 5 is a development perspective view describing the method for manufacturing the electrodynamic speaker 1*a*.

The structure other than the method for fixing the edge 30 and the tinsel wire 7 is common between present embodiment and the electrodynamic speaker 1 of the above-described embodiment. Therefore, same components are denoted by same reference numerals, and the description thereof is omitted.

The edge 30 of the electrodynamic speaker 1*a* in present embodiment is similar to the edge 3 in the above embodiment in that it includes the inner periphery fixing section 3*a* to be coupled to the outer peripheral end of the diaphragm 2, the outer periphery fixing section 3*b* fixed to the edge mounting section 61 of the frame 6, and the support movable section 3*c* for coupling the inner periphery fixing section 3*a* and the outer periphery fixing section 3*b* in the vibration-enabled manner. In the edge 30 in present embodiment, the outer periphery fixing section 3*b* has two protrusions 31 corresponding to the voids 65 of the edge mounting section 61 of the frame 6. The protrusions 31 of the edge 30 are partially held in the voids 65 of the frame so that a tinsel wire fixing section for fixing the middle portion of the tinsel wire 7 is formed in a state where the electrodynamic speaker 1*a* is assembled. That is to say, the outer periphery fixing section 3*b* corresponding to the gasket for mounting the edge 30 to the frame 6 is formed so as to have the protrusions 31 including the tinsel wire fixing sections for fixing the middle portion of the tinsel wire 7. The tinsel wire fixing sections of the protrusions 31 may be formed with holes through which the tinsel wire 7 passes, and may be portions including a structure such that a plurality of claw-shaped sections nip the tinsel wire 7.

Therefore, when the protrusions 31 are entirely or partially held in the voids 65 of the edge mounting section 61 of the frame 6, since the protrusions 31 including the tinsel wire fixing sections fix the middle portion of the tinsel wire 7, the number of steps of forming the tinsel wire 7 to be connected to the voice coil 4 can be further reduced in the electrodynamic speaker 1*a* of present embodiment. When the edge 30 is placed and fixed to the edge mounting section 61 of the frame 6, the middle portion of the tinsel wire 7 is allowed to easily pass through the voids 65 of the frame 6 or the window sections 64 communicatively connected to the voids 65, and thus the step of forming the tinsel wire 7 is not additionally required. The electrodynamic speaker 1*a* of present embodiment has an advantage such that the tinsel wire 7 can be shaped in advance before the diaphragm 2 and the edge 30 are placed on the frame 6.

As described in the above embodiment, the diaphragm 2 and the edge 30 may be formed integrally by different resins according to the methods such as two-color formation, and at least the diaphragm 2 and the support movable section 3*c* of the edge 30 may be made of different materials. Further, the diaphragm 2 and the outer periphery fixing section 3*b* of the edge 30 may be made of the same material. There is an advantage such that the protrusions 31 including the tinsel wire fixing sections for fixing the middle portion of the tinsel wire 7 can be easily formed. The problem such that when the tinsel wire 7 is arranged on the diaphragm 2 and the rear surface of the edge 30, the tinsel wire 7 contacts with another portion and a noise is generated due to variability at the time of mass production can be reduced. As a result, the electrodynamic speaker 1 where a defective operation is less and thus the operation is stable can be realized.

Needless to say, in the frame 6 used for the electrodynamic speakers 1 and 1*a*, the voids 65 of the edge mounting section 61 may be provided correspondingly to a plurality of tinsel wires, respectively, or at least one or more voids 65 may be provided so that the plurality of adjacent tinsel wires 7 is allowed to pass collectively therethrough. Further, when a portion where the tinsel wire 7 is formed is provided on the assembly jig 20, the speaker diaphragm 2, the edge 3*b*, the speaker vibration system including the voice coil 4 and the tinsel wire 7 can be accurately located with respect to the magnetic circuit fixed to the frame 6. For this reason, the electrodynamic speakers 1 and 1*a* whose operation is stable can be realized.

The electrodynamic speakers 1 and 1*a* in the above embodiments are track-shaped speakers whose short radial direction is shorter than its long radial direction, but the present invention can be applied also to a speaker using an approximately circular frame corresponding to a cone-shaped speaker diaphragm whose outer diameter is circular. When the shape and the dimension of the approximately circular frame in the small speaker are limited, the tinsel wire is easily located with respect to the frame. For this reason, the defect such that the tinsel wire 7 contacts with another portion and a noise is generated can be reduced, and the speakers whose operation is stable can be realized.

The electrodynamic speaker and the manufacturing method of the same according to the present invention can be applied not only to small speakers but also to headphones.

What is claimed is:

1. An electrodynamic speaker, comprising:

a frame having an approximately basket-shaped substrate;

an integrated vibration system to be held in the frame, the integrated vibration system including a diaphragm, an edge coupled to an outer peripheral end of the diaphragm, a voice coil connected to the diaphragm, and a tinsel wire whose one end is connected and fixed to the voice coil, the diaphragm, edge, voice coil and tinsel wire configured to be insertable as an integral combination into the frame;

a magnetic circuit having a magnetic void into which the voice coil of the integrated vibration system is inserted;

a terminal to be coupled to the frame;

the frame including an edge mounting section for mounting the edge formed on one side of the substrate, a magnetic circuit mounting section for mounting the magnetic circuit formed on the other side of the substrate, a coupling section for coupling the edge mounting section and the magnetic circuit mounting section so as to define a plurality of window sections, a terminal fixing section for fixing the terminal, and at least one void for dividing the edge mounting section having an approximately annular shape, the void being communicatively connected to the window sections of the coupling section, wherein, with the integrated vibration system inserted into the frame, a middle portion of the tinsel wire is passable through the void or the window sections communicatively connected to the void, and the other end of the tinsel wire is connectable and fixable to the terminal.

2. An electrodynamic speaker comprising:

a frame having an approximately basket-shaped substrate;

a diaphragm to be held in the frame;

an edge to be coupled to an outer peripheral end of the diaphragm;

a voice coil to be connected to the diaphragm;

a magnetic circuit having a magnetic void into which the voice coil is inserted;

a tinsel wire whose one end is connected and fixed to the voice coil; and a terminal to be coupled to the frame, wherein the frame includes an edge mounting section for mounting the edge formed on one side of the substrate, a magnetic circuit mounting section for mounting the magnetic circuit formed on the other side of the substrate, a coupling section for coupling the edge mounting section and the magnetic circuit mounting section so as to define a plurality of window sections, a terminal fixing section for fixing the terminal, and at least one void for dividing the edge mounting section having an approximately annular shape, the void being communicatively connected to the window sections of the coupling section, wherein a middle portion of the tinsel wire passes through the void or the window sections communicatively connected to the void, and the other end of the tinsel wire is connected and fixed to the terminal, wherein the edge includes an inner periphery fixing section to be coupled to the outer peripheral end of the diaphragm, an outer periphery fixing section to be fixed to the edge mounting section of the frame, and a support movable section for coupling the inner periphery fixing section and the outer periphery fixing section in a vibration-enabled manner, and wherein the outer periphery fixing section includes a tinsel wire fixing section that has a protrusion on a position corresponding to the void of the edge mounting section and fixes the middle portion of the tinsel wire using the protrusion that is entirely or partially held in the void.

3. The electrodynamic speaker according to claim 2, wherein the diaphragm and the edge are formed integrally with each other, and at least the diaphragm and the support movable section of the edge are made of different materials.

4. The electrodynamic speaker according to claim 3, wherein the diaphragm and the outer periphery fixing section of the edge are made of the same material.

5. A method for manufacturing an electrodynamic speaker, the electrodynamic speaker including a frame having an approximately basket-shaped substrate, a diaphragm to be held in the frame, an edge to be coupled to an outer peripheral end of the diaphragm, a voice coil to be coupled to the diaphragm, a magnetic circuit having a magnetic void into which the voice coil is inserted, a tinsel wire whose one end is connected and fixed to the voice coil, and a terminal to be coupled to the frame, the method comprising the steps of:

forming the frame including an edge mounting section for mounting the edge formed on one side of the substrate, a magnetic circuit mounting section for mounting the magnetic circuit formed on the other side of the substrate, a coupling section for coupling the edge mounting section and the magnetic circuit mounting section so as to define a plurality of window sections, a terminal fixing section for fixing the terminal, and at least one void for dividing the edge mounting section having an approximately annular shape, the void being communicatively connected to the window sections of the connecting section;

coupling the terminal to the terminal fixing section of the frame;

coupling the diaphragm, the edge, the voice coil and the tinsel wire so as to constitute a vibration system;

when the vibration system is moved from one side to the other side of the substrate of the frame, allowing a middle portion of the tinsel wire to pass through the void of the frame or the window sections communicatively connected to the void and placing and fixing the edge to the edge mounting section of the frame;

connecting and fixing the other end of the tinsel wire to the terminal; and mounting the magnetic circuit to the magnetic circuit mounting section of the frame so as to arrange the voice coil on the magnetic void of the magnetic circuit.

6. The method for manufacturing the electrodynamic speaker according to claim 5, further comprising the steps of:

forming the edge so that the edge includes an inner periphery fixing section to be coupled to the outer peripheral end of the diaphragm, an outer periphery fixing section to be fixed to the edge mounting section of the frame, and a support movable section for coupling the inner periphery fixing section and the outer periphery fixing section in a vibration-enabled manner, and the outer periphery fixing section includes a tinsel wire fixing section for fixing the middle portion of the tinsel wire to a protrusion on a position corresponding to the void of the edge mounting section;

placing and fixing the edge on the edge mounting section of the frame so that the protrusion including the tinsel wire fixing section is entirely or partially held in the void; and fixing the middle portion of the tinsel wire using the tinsel wire fixing section.

7. The method for manufacturing the electrodynamic speaker according to claim 6, further comprising a step of forming the diaphragm and the edge integrally so that at least the diaphragm and the support movable section of the edge are made of different materials.

8. The method for manufacturing the electrodynamic speaker according to claim 7, further comprising a step of forming the diaphragm and the outer periphery fixing section of the edge using the same material.

* * * * *